US005361962A

United States Patent [19]

Andersen et al.

[11] Patent Number: 5,361,962

[45] Date of Patent: Nov. 8, 1994

[54] STITCHING MACHINE HEAD AND MAGNETIC WIRE HOLDER THEREFOR

[76] Inventors: Norman E. Andersen, 1431 Foxtail Dr. Unit 204; Larry A. Sikora, 6006 Quaker Hill Rd., both of Racine, Wis. 53406

[21] Appl. No.: 97,089

[22] Filed: Jul. 23, 1993

[51] Int. Cl.[5] ..... B27F 7/23

[52] U.S. Cl. ..... 227/90; 227/91; 227/113

[58] Field of Search ..... 227/82, 88, 90, 113; 81/24

[56] References Cited

U.S. PATENT DOCUMENTS

| | | | |
|---|---|---|---|
| 2,414,390 | 1/1947 | Pagliarul | 227/91 |
| 2,697,829 | 12/1954 | Winkler | 227/113 |
| 2,962,720 | 12/1960 | Quednau | 227/88 |
| 3,065,470 | 11/1962 | Schmidt | 227/113 |
| 3,292,837 | 12/1966 | Heil et al. | 227/113 |
| 3,403,832 | 10/1968 | Pabich | 227/113 |
| 3,580,312 | 5/1971 | Hallock | 81/24 |
| 3,642,187 | 2/1972 | Barland . | |
| 3,747,825 | 7/1973 | Barland . | |
| 3,848,790 | 11/1974 | Verwey et al. . | |
| 4,202,481 | 5/1980 | Yanagida et al. . | |
| 4,211,350 | 7/1980 | Kunka et al. . | |
| 4,410,123 | 10/1983 | Kunka et al. . | |
| 4,505,415 | 3/1985 | Gruen . | |
| 4,708,277 | 11/1987 | Schlough . | |
| 4,722,467 | 2/1988 | Kunka et al. . | |
| 5,098,002 | 3/1992 | Hansch et al. . | |
| 5,199,625 | 4/1993 | Dewey et al. . | |

FOREIGN PATENT DOCUMENTS

| | | | |
|---|---|---|---|
| 1335243 | 7/1963 | France | 81/24 |

*Primary Examiner*—Scott A. Smith

[57] ABSTRACT

A rotatable wire holder for a stitching machine head has a wire-receiving slot between two wire support surfaces, and wire cam surfaces which guide the wire from the slot to the support surfaces in response to rotation of the holder. Permanent magnets hold the wire on the support surfaces. The holder is used in a stitching machine head including feed mechanism for gripping and feeding a length of wire from a continuous coil supply to the holder, a cutter for severing the length of wire from the supply and a former/driver movable past the holder for forming the held length of wire into a staple and driving the formed staple into an associated workpiece.

10 Claims, 2 Drawing Sheets

STITCHING MACHINE HEAD AND MAGNETIC WIRE HOLDER THEREFOR

BACKGROUND OF THE INVENTION

1. Field of the Invention

The present invention relates to wire stitching or stapling machines of the type which sever and form staples from a continuous wire and drive the staples into an associated workpiece. In particular, the invention relates to a rotatable wire holder for such a stitching machine.

2. Description of the Prior Art

The present invention is an improvement in a stitching machine head of the type which is sold by Interlake Packaging Corp. under the trade designation "CHAMPION STITCHER". One type of such a stitching machine head is disclosed, for example, in U.S. Pat. No. 4,410,123. The stitching machine head has a wire feed mechanism for feeding a predetermined length of wire from a continuous wire supply to a rotatable wire holder, where the length of wire is severed from the supply, and a staple forming and driving mechanism which forms the severed length of wire into a staple and drives it into an associated workpiece.

The wire feed mechanism and the staple forming and driving mechanism are coupled together so that they undergo a reciprocating movement in tandem, moving together in the same direction in response to an associated drive. Thus, the mechanism undergoes a cyclical reciprocating movement comprising a drive stroke and a return stroke. During each drive stroke the feed mechanism feeds a predetermined length of wire into a slot in the wire holder, while the staple forming and driving means forms and drives the length of wire which had been fed and cut during the preceding drive stroke. Both mechanisms then retract simultaneously, and at the end of each cycle there is left in the wire holder a severed length of wire ready to be formed and driven during the next drive stroke.

In the type of stitching machine head disclosed in the aforementioned U.S. Pat. No. 4,410,123, as the drive stroke begins, the cut length of wire which was fed in the previous cycle, is held in a horizontal orientation perpendicular to the direction of the drive stroke. During the drive stroke the wire is first formed over the wire holder by the staple forming and driving mechanism, which then cams the wire holder outwardly along its axis out of the path of the staple forming and driving mechanism, which picks up the formed staple and drives it into the associated workpiece. As the cut length of wire is being formed, a new length of wire is being fed parallel to the direction of the drive stroke into the holder slot behind a pivoting hook. As the wire holder is cammed out of the way by the staple forming and driving mechanism, a linkage rotates the wire holder on its axis through about 90°, in response to which the newly fed wire is guided by wire cam surfaces on the holder up out of the slot and onto substantially coplanar support surfaces on either side of the slot. As the drive stroke continues, the newly fed length of wire is severed from the supply, the severed length of wire being held against the support surfaces by the hook. During the retraction stroke the holder is pivoted back to its original orientation and, as the staple forming and driving mechanism clears it, moves axially back into its original position, returning the cut length of wire to a horizontal orientation for forming during the next cycle, the cut length of wire being held in place on the support surfaces by the hook during this rotation.

This type of rotatable wire holder has been subject to a number of disadvantages. It is prone to misfeeds, in that the leading end of the wire being fed into the holder may catch on the hook or on the edge of the slot accommodating the hook. The holder comprises movable parts, viz., the hook and its bias spring, which can fail and which necessitate costly and time consuming assembly. The slot for the hook is formed closely adjacent to and at an angle to the wire-receiving notch, resulting in a thin finger of material at one side of the slot which becomes brittle during heat treating of the holder and tends to break off in use.

SUMMARY OF THE INVENTION

It is a general object of the invention to provide an improved stitching machine head and wire holder therefor which avoid the disadvantages of prior constructions while affording additional structural and operating advantages.

An important feature of the invention is the provision of a wire holder which is of relatively simple and economical construction.

In connection of the foregoing feature, another feature of the invention is the provision of a wire holder of the type set forth which has no moving parts.

Yet another feature of the invention is the provision of a wire holder of the type set forth which reduces the chance of wire misfeeds.

Still another feature of the invention is the provision of a wire holder of the type set forth which can be heat treated without adverse consequences.

Another feature of the invention is the provision of a wire stitching machine head incorporating a wire holder of the type set forth.

These and other features are attained by providing a wire holder for use in holding a length of wire in a forming region of a stitching machine head for formation into a stapler, the holder comprising: a generally cylindrical body having an axis, an aperture formed in the body at one end thereof for receiving a severed length of wire oriented substantially perpendicular to the axis, a wire support surface on the body adjacent to the aperture for supporting engagement with the severed length of wire, and magnetic means adjacent to the support surface for magnetically holding the severed length of wire thereon.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
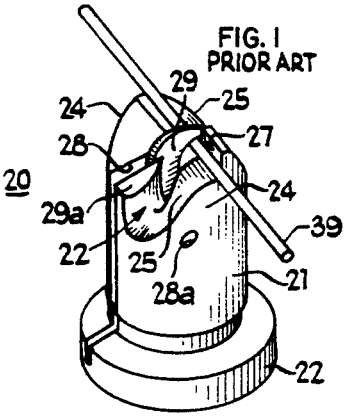
FIG. 1 PRIOR ART
FIG. 1 is a perspective view of a prior art wire holder with a wire held thereon.
Figure 2:
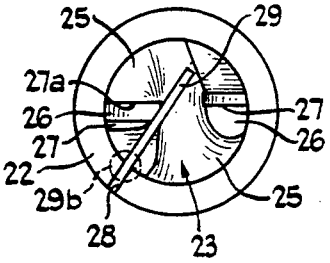
FIG. 2 PRIOR ART
FIG. 2 is a top plan view of the wire holder of FIG. 1 with the wire removed.
Figure 3:
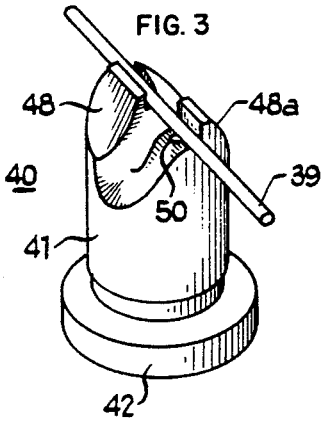
FIG. 3 is a view similar to FIG. 1, and illustrating the wire holder of the present invention with a wire held thereon.
Figure 4:
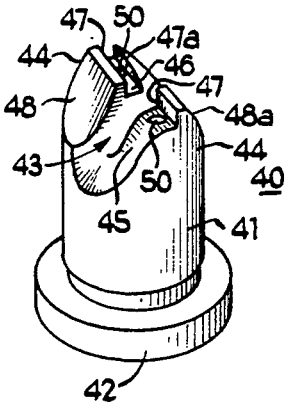
FIG. 4 is a view similar to FIG. 3, illustrating the wire holder without the wire thereon.
Figure 5:
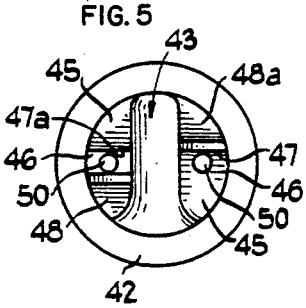
FIG. 5 is a top plan view of the wire holder of FIG. 4.
Figure 6:
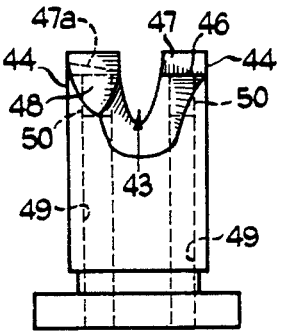
FIG. 6 is a front elevational view of the wire holder of FIG. 4.
Figure 7:
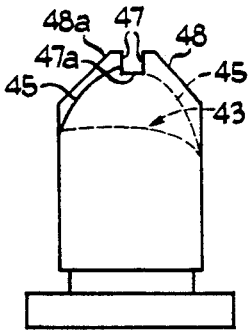
FIG. 7 is a side elevational view of the wire holder of FIG. 6, as viewed from the left-hand side thereof.

Referring to FIGS. 1 and 2, there is illustrated a prior art wire holder 20 of the type used in stitching machine heads of the type disclosed in the aforementioned U.S. Pat. No. 4,410,123. The holder 20 has a circularly cylindrical shank or body 21 provided at one end with a radially outwardly extending annular flange 22. Formed substantially diametrically through the shank 21 at the other end thereof is a wire-receiving slot or aperture 23 which divides that end of the shank 21 into a pair of laterally spaced-apart arms 24. Respectively formed on the arms 24 are two wire cam surfaces 25, one on the front side of the associated arm and the other on the rear side of the associated arm, the cam surfaces 25 curving respectively upwardly from opposite ends of the slot 23 and respectively terminating at substantially coplanar support surfaces 26, respectively formed on the arms 24 substantially perpendicular to the axis of the shank 21. Each of the support surfaces 26 is bounded on the side thereof opposite the associated wire cam surface 25 by an upstanding retaining surface 27, the support surface 26 which joins the rear cam surface 25 also being provided adjacent to that cam surface 25 with a short upstanding retaining surface 27*a*. The retaining surfaces 27 and 27*a* cooperate to define a groove or channel which extends across the arms 24 and crosses the slot 23 substantially perpendicular thereto.

Formed longitudinally through one of the arms 24 and the shank 21 is a slot 28 in which is disposed a hook 29 which projects into and across the slot 23 at an acute angle thereto. The hook 29 is pivotally mounted on a pin 28*a*, being biased in a clockwise direction, as illustrated in FIG. 1, by a helical compression spring 29*b*. In operation, the hook 29 serves to hold a cut length of wire 39 against the support surfaces 26 in the groove defined by the retaining surfaces 27 and 27*a*, as is illustrated in FIG. 1.

Because the hook 29 crosses the slot 23, it can tend to interfere with feeding of wire into the slot 23, unless the feed wire is sufficiently straight and properly aligned. Furthermore, the slot 28 for the hook 29 must be so positioned that it forms a very thin finger 29*a* at one side of the associated arm 24, which finger 29*a* tends to become embrittled during hardening and to break in use.

Figure 9:
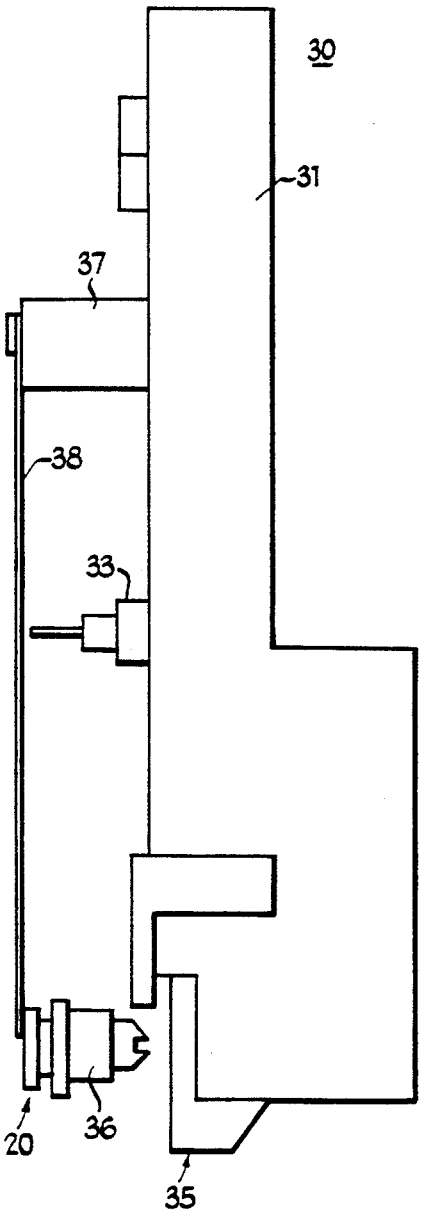
FIG. 9 is a simplified side elevational view of a stitching machine head incorporating the wire holder of FIGS. 1 and 2.
Figure 14A:
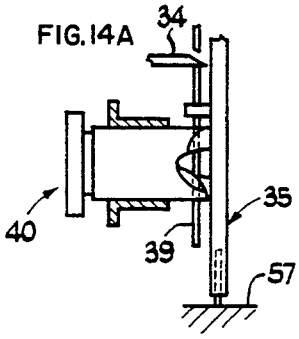
FIGS. 14A and 14B are views similar to FIGS. 13A and 13B illustrating the parts near the end of the drive stroke.
Figure 14B:
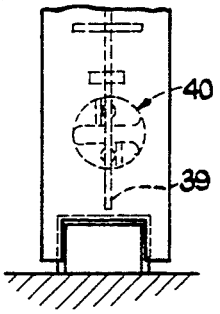
Figure 15A:
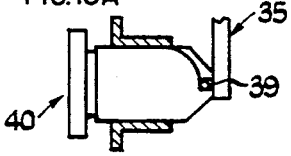
FIGS. 15A and 15B are views similar to FIGS. 14A and 14B illustrating the parts during the return stroke.
Figure 15B:
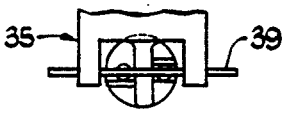

Referring now to FIG. 9, there is illustrated in simplified form a stitching machine head 30, generally of the type disclosed in the aforementioned U.S. Pat. No. 4,410,123, and with which the holder 20 is intended to be used. Only so much of the stitching machine head 30 as is necessary to an understanding of the present invention has been illustrated. Further details are found in U.S. Pat. No. 4,410,123, the disclosure of which is incorporated herein by reference. The stitching machine head 30 has a frame 31 and is adapted for feeding wire 32 (see FIG. 11A) from an associated coil supply (not shown). The wire 32 extends down alongside the front face of the frame 31 and is gripped by a wire feed mechanism 33, which reciprocates vertically to feed the wire to the wire holder 20. The stitching machine head 30 is provided with a cutter 34 (see FIG. 14A) to sever a cut length of wire 39 from the feed wire 32 after it has been fed through the holder 20. The head 30 also includes a staple forming and driving mechanism 35 which reciprocates with the wire feed mechanism 30, downwardly along a drive stroke for forming the cut length of wire 39 into a staple and driving it into an associated workpiece, and upwardly along a retraction stroke. The staple forming and driving mechanism 35 is illustrated in FIG. 9 at the bottom of its drive stroke. The holder 20 is supported in a cylindrical bracket 36 which is mounted on the frame 31 by suitable means. An operating cam 37 is rotated at predetermined points in the cycle of the staple forming and driving mechanism 35 and is coupled by an operating link arm 38 to the wire holder 20 for effecting a corresponding rotation of the wire holder 20.

Referring to FIGS. 3–8, there is illustrated a wire holder 40 constructed in accordance with and embodying the features of the present invention, and which can be substituted for the wire holder 20. The wire holder 40 has a cylindrical shank 41 provided at one end thereof with a radially outwardly extending annular flange 42. Extending generally diametrically across the shank 41 at the opposite end thereof is a wire-receiving slot or aperture 43 which divides that end of the shank 41 into a pair of laterally spaced-apart arms 44. The arms 44 are respectively provided with wire cam surfaces 45, one formed on the front side of the associated arm 44 and the other formed on the rear side of the associated arm 44, the wire cam surfaces 45 respectively curving upwardly from opposite ends of the slot 43 and respectively terminating at substantially coplanar support surfaces 46, respectively on the arms 44. Respectively projecting upwardly from the support surfaces 46 at the sides thereof opposite the associated wire cam surfaces 45 are retaining surfaces 47. Also projecting a slight distance upwardly from one of the support surfaces 46 adjacent to its associated wire cam surface 45 is a short retaining surface 47*a*. That arm 44 is also provided opposite its wire cam surface 45 with a sloping cam surface 48. The other arm 44 is provided opposite its wire cam surface 45 with a sloping clearance surface 48*a*.

Figure 8:
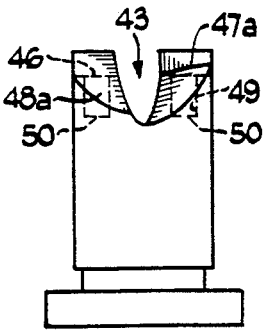
FIG. 8 is a rear elevational view of the wire holder of FIG. 6.

Extending longitudinally through the shank 41 substantially parallel to the longitudinal axis thereof are two cavities in the form of elongated cylindrical bores 49 which enter at the flange 42 and exit, respectively, at the support surfaces 46. Respectively disposed in the bores 49 are two cylindrical permanent magnets 50 with the outer end faces thereof preferably substantially coplanar with the support surfaces 46. In use, the magnets 50 may be inserted in the bores 49 from the flange end of the wire holder 40. This arrangement is preferred if the size of the magnets 50 is such that the bores 49 must be wider than the support surfaces 46. Alternatively, it will be appreciated that the bores 49 could be formed in the support surfaces 46 and extend into the shank 41 only the distance necessary to accommodate the magnets 50, as is indicated in FIG. 8. The permanent magnets 50 may be of any of a number of commercially available types. In general, it is desirable to use a magnet which provides the greatest magnetic force in the smallest size. While the magnets 50 are preferably magnetically retained in place in the bores 49, it will be appreciated that they could also be retained by other means, such as adhesives or interference fit, in the event that the wire holder 40 is formed of a non-magnetic material.

Figure 10A:
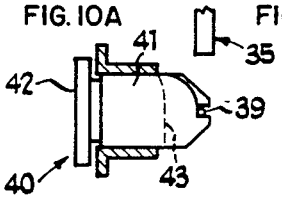
FIG. 10A is a fragmentary side elevational view of the wire holder of FIGS. 3–8 and associated portions of the stitching machine head of FIG. 9 in simplified form, with the parts illustrated in a rest configuration at the beginning of a drive stroke, and illustrating a previously-cut length of wire held in the wire holder.
Figure 10B:
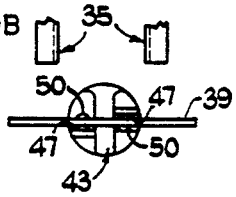
FIG. 10B is a fragmentary end elevational view of the structure of FIG. 10A, as viewed from the right-hand end thereof.

Referring now also to FIGS. 10A through 15B, the operation of the stitching machine head 30 utilizing the wire holder 40 in place of wire holder 20 will be described. FIGS. 10A and 10B illustrate the mechanism in its normal rest configuration, with the staple forming and driving mechanism 35 fully retracted, with the wire holder 40 fully extended into the bracket 36 beneath the staple forming and driving mechanism 35, and with a cut length of wire 39, which was cut during the previous drive cycle, retained in place on the support surfaces 46 by the magnets 50 in a forming region of the head 30. The wire holder 40 is rotationally oriented so that the cut length of wire 39 is disposed horizontally, i.e., substantially perpendicular to the direction of travel of the staple forming and driving mechanism 35.

Figure 11A:
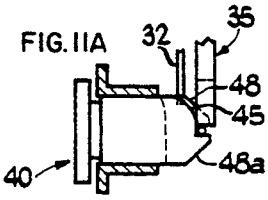
FIGS. 11A and 11B are views similar to FIGS. 10A and 10B, and illustrating the parts in a second configuration during the initial portion of a drive stroke.
Figure 11B:
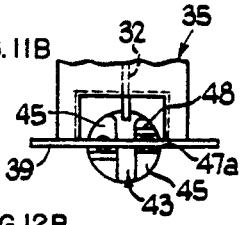
Figure 12A:
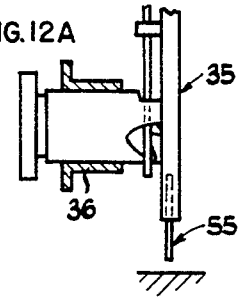
FIGS. 12A and 12B are views similar to FIGS. 11A and 11B illustrating the parts further along the drive stroke.
Figure 12B:
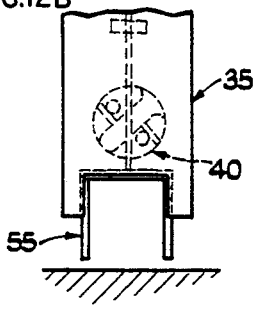
Figure 13A:
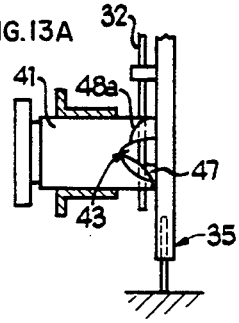
FIGS. 13A and 13B are views similar to FIGS. 12A and 12B and illustrating the parts still further along the drive stroke.
Figure 13B:
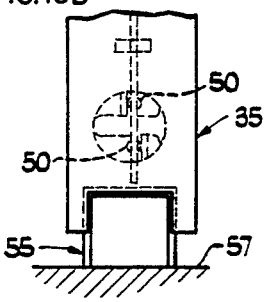

The staple forming and driving mechanism 35 includes a former with a generally inverted U-shaped lower end with depending legs which straddle the wire holder 40 as the staple forming and driving mechanism 35 begins moving downwardly along its drive stroke, as is illustrated in FIGS. 11A and 11B. Simultaneously, the wire feed mechanism 33 pulls down the feed wire 32 and feeds its distal end into the slot 43 of the wire holder 40, behind the cut length of wire 39. The depending legs of the staple forming and driving mechanism 35 engage the projecting ends of the cut wire length 39 and bend them downwardly over the retaining surfaces 47 and 47*a* of the wire holder 40 to form a generally inverted U-shaped staple 55, in a known manner, as is illustrated in FIGS. 12A and 12B. The legs of the staple 55 respectively fit in grooves on the inner sides of the depending legs of the staple forming and driving mechanism 35.

As the drive stroke continues between the configurations of FIGS. 11A and 12A, the portion of the staple forming and driving mechanism 35 between the depending legs thereof engages the cam surface 48 and cams the wire holder 40 axially to the left, as viewed in FIG. 11A. As the staple forming and driving mechanism 35 starts to cam past the wire holder 40 it picks up the formed staple 55 therefrom. Meanwhile, the wire 32 continues to be fed downwardly into the slot 43. Also, simultaneously the operating cam 37 begins to rotate, effecting a corresponding rotation of the wire holder 40 in a clockwise direction as viewed in FIGS. 12A and 12B, causing the wire 32 to slide along the wire cam surfaces 45 and be guided up out of the slot 43 onto the support surfaces 46. The rotation of the wire holder 40 continues through 90°, arriving at the position illustrated in FIGS. 13A and 13B, wherein the wire 32 is seated on the support surfaces 46.

As the drive stroke continues, the staple 55 is driven through the associated workpiece 57, as is illustrated in FIGS. 13A through 14B. As the mechanism reaches the end of its drive stroke, the cutter 34 is actuated to sever from the feed wire 32 the cut length of wire 39, which is retained in place on the support surfaces 46 of the wire holder 40 by the magnets 50. As the staple forming and driving mechanism 35 retracts, the operating cam 37 rotates back in the opposite direction, effecting a corresponding rotation of the wire holder 40 in a clockwise direction, as viewed in FIG. 14B, back to the original orientation illustrated in FIG. 10A, carrying with it the cut length of wire 39. It will be appreciated that, as the staple forming and driving mechanism 35 clears the wire holder 40, the wire holder 40 returns axially to the right, as viewed in FIG. 15A to its original position of FIG. 10A under the urging of the operating link arm 38, which also serves as a bias spring.

It is a significant aspect of the invention that the wire holder 40 effectively holds the cut length of wire 39 in place thereon without the use of any moving parts and, in particular, without the use of a pivoting hook. Thus, there is nothing to obstruct the feeding of the wire 32 into the slot 43. Accordingly, misfeeds and associated dropped stitches are significantly reduced with the use of the wire holder 40. Also, because there are no moving parts, the manufacture of the wire holder 40 is simpler and less expensive, and the part can be safely heat treated because there are no thin cantilevered parts which are subject to embrittlement and breakage.

We claim:

1. A wire holder for use in holding a length of wire in a forming region of a stitching machine head for formation into a staple, said holder comprising:

a body having a cylindrical outer surface and a longitudinal axis and a forward end, a slot formed diametrically across said forward end of said body for receiving a length of wire oriented substantially perpendicular to said axis, first and second elongated substantially coplanar wire support surfaces on said forward end of said body each extending substantially perpendicular to said slot from said outer surface of said body to said slot, two sloping cam surfaces respectively disposed on opposite sides of said slot and respectively extending between said slot and said first and second wire support surfaces, two elongated cylindrical cavities formed in said body respectively on opposite sides of said slot and extending substantially parallel to said axis and respectively communicating with said first and second wire support surfaces, each of said cavities being spaced from said slot and from said outer surface of said body and having a transverse cross section which does not extend substantially beyond the associated one of said wire support surfaces, and two cylindrical permanent magnets respectively disposed in said cavities and each having an end surface substantially coplanar with the associated one of said wire support surfaces for magnetically holding the associated length of wire thereon.

2. The wire holder of claim 1, wherein each of said cavities and said magnets is circular in transverse cross section.

3. The wire holder of claim 1, wherein each of said cavities has a longitudinal extent substantially less than that of said body.

4. The wire holder of claim 1, wherein said first wire support surface has opposite side edges and is bounded by retaining surfaces respectively extending from said side edges substantially perpendicular to said first wire support surface, one of said retaining surfaces having a distal end edge sloping rearwardly of said body and radially inwardly toward said slot, one of said cam surfaces extending between said slot and said distal end edge of said one of said retaining surfaces.

5. The wire holder of claim 4, wherein said second wire support surface has side edges and is bounded by at least one retaining surface extending from one of said side edges substantially perpendicular to said second wire support surface.

6. In a wire stitching machine head including feed mechanism for gripping and feeding a length of wire from a continuous coil supply thereof to a forming region, a wire holder for holding the length of wire in the forming region and including a body having a cylindrical outer surface and a longitudinal axis and a forward end and a slot formed diametrically across the forward end of the body for receiving the length of wire oriented substantially perpendicular to the axis, a cutter for cutting the wire from the supply, a former/driver movable through the forming region for forming the severed length of wire into a staple and driving the formed staple into an associated workpiece, and rotation mechanism for rotating the wire holder about its longitudinal axis, the improvement comprising:

first and second elongated substantially coplanar wire support surfaces on the forward end of the body each extending substantially perpendicular to the slot from the outer surface of the body to the slot, two sloping cam surfaces respectively disposed on opposite sides of the slot and respectively extending between the slot and said first and second wire support surfaces, two elongated cylindrical cavities formed in the body respectively on opposite sides of the slot and extending substantially parallel to the axis and respectively communicating with said first and second wire support surfaces, each of said cavities being spaced from the slot and from the outer surface of the body and having a transverse cross section which does not extend substantially beyond the associated one of said wire support surfaces, and two cylindrical permanent magnets respectively disposed in said cavities and each having an end surface substantially coplanar with the associated one of said wire support surfaces for magnetically holding the associated length of wire thereon.

7. The stitching machine head of claim 6, wherein each of said cavities and said magnets is circular in transverse cross section.

8. The wire holder of claim 6, wherein each of said cavities has a longitudinal extent substantially less than that of said body.

9. The stitching machine head of claim 6, wherein said first wire support surface has opposite side edges and is bounded by retaining surfaces respectively extending from said side edges substantially perpendicular to said first wire support surface, one of said retaining surfaces having a distal end sloping rearwardly of said body and radially inwardly toward said slot, one of said cam surfaces extending between said slot and said distal end edge of said one of said retaining surfaces.

10. The stitching machine head of claim 9, wherein said second wire support surface has side edges and is bounded by at least one retaining surface extending from one of said side edges substantially perpendicular to said second wire support surface.

* * * * *

UNITED STATES PATENT AND TRADEMARK OFFICE

CERTIFICATE OF CORRECTION

PATENT NO. : 5,361,962

DATED : November 8, 1994

INVENTOR(S) : Norman E. Andersen and Larry A. Sikora

It is certified that error appears in the above-identified patent and that said Letters Patent is hereby corrected as shown below:

Column 8, line 37, after the word "end", insert --edge--.

Signed and Sealed this

Fourteenth Day of February, 1995

*Attest:*

Bruce Lehman

BRUCE LEHMAN

*Attesting Officer*

*Commissioner of Patents and Trademarks*